United States Patent [19]

Uemura et al.

[11] Patent Number: 4,470,960

[45] **Date of Patent: * Sep. 11, 1984**

[54] PROCESS FOR THE PRODUCTION OF PITCH-DERIVED CARBON FIBERS

[75] Inventors: Seiichi Uemura, Tokyo; Shunichi Yamamoto; Takao Hirose, both of Kamakura; Hiroaki Takashima, Kawasaki; Osamu Kato, Yokohama, all of Japan

[73] Assignee: Nippon Oil Co., Ltd., Tokyo, Japan

[ * ] Notice: The portion of the term of this patent subsequent to Jul. 5, 2000 has been disclaimed.

[21] Appl. No.: 437,132

[22] Filed: Oct. 27, 1982

[30] Foreign Application Priority Data

Oct. 29, 1981 [JP] Japan ..... 56-172076

[51] Int. Cl.[3] ..... D01F 9/12; C10C 3/02

[52] U.S. Cl. ..... 423/447.1; 423/447.6; 208/22; 208/40

[58] Field of Search ..... 423/447.1, 447.2, 447.4, 423/447.6, 447.7, 447.8; 208/22, 39, 40, 44; 264/29.2

[56] References Cited

U.S. PATENT DOCUMENTS

| | | | |
|---|---|---|---|
| 4,177,132 | 12/1979 | Uemura et al. | 208/40 |
| 4,243,512 | 1/1981 | Seo | 423/447.1 |
| 4,271,006 | 6/1981 | Dickakian | 208/45 |
| 4,391,788 | 7/1983 | Uemura et al. | 423/447.6 |
| 4,397,830 | 8/1983 | Uemura et al. | 423/447.1 |

*Primary Examiner*—John Doll
*Assistant Examiner*—Steven Capella
*Attorney, Agent, or Firm*—Bucknam and Archer

[57] ABSTRACT

A process for the production of carbon fibers which comprises using a specific optically isotropic pitch having a reflectivity of 9.0–11.0% as the material for the carbon fibers.

6 Claims, No Drawings

PROCESS FOR THE PRODUCTION OF PITCH-DERIVED CARBON FIBERS

This invention relates to an excellent specific pitch for producing high performance carbon fibers.

There have recently been reported many methods for producing carbon fibers from pitch. In each of these reported methods, it is essential to use as the starting material a pitch containing at least a certain amount of optically anisotropic liquid crystal called "mesophase" in order to produce carbon fibers having excellent Young's modulus, tensile strength and like properties. For example, Japanese Patent Gazette 55-37611 discloses the use of a pitch containing 40–90% of mesophase, Japanese Pat. Appln. Laid-Open Gazette 55-144087 the use of a pitch containing at least 75% of mesophase and Japanese Pat. Appln. Laid-Open Gazette 54-55625 the use of a pitch consisting substantially of 100% of mesophase.

It has been considered that the use of a mesophase-containing pitch is essential as the starting material to produce high performance carbon fibers, while a mesophase-free pitch, that is an optically isotropic pitch, will not produce a high performance pitch but produce only a general-purpose grade pitch.

As mentioned above, the presence of mesophase in pitch has been considered as an important factor in determining the performance of the resulting carbon fibers in the technical field concerned. This is based on the fact that the mesophase forms a laminate structure wherein condensed polycyclic aromatic planar molecules are arranged parallel to one another and the laminate structure is apt to be arranged parallel to the axis of the resulting fibers in the melt spinning step.

However, the mesophase pitch will raise problems as to thermal degeneration such as an increase of quinoline-insoluble ingredients and evolution of decomposition gases in the melt spinning step since it generally has a high softening point. This is remarkable particularly with the substantially 100% mesophase pitch because of its extremely high softening point. Further, it is difficult to melt spin uniformly a pitch containing the mesophase and non-mesophase portions in admixture since the pitch is a non-uniform mixture of regularly arranged component molecules and irregularly arranged ones.

It is most preferable if carbon fibers having high tensile modulus and high tensile strength can be produced from a pitch which contains no mesophase portions, has a low softening point and is uniform at the time of melt spinning.

In view of this, the present inventors made intensive studies in an attempt to find a process for producing high performance carbon fibers from an optically isotropic pitch containing no mesophase portions and, as a result of their studies, they found that high performance carbon fibers can be produced from a specific pitch having a specific reflectivity or reflectance even if the pitch is an optically isotropic one, thus accomplishing this invention. This invention is based on this finding or discovery.

This invention is directed to a process for producing carbon fibers from a specific pitch which is an optically isotropic pitch having a reflectivity of 9.0–11.0% as the starting material.

The reflectivity is determined by embedding a test pitch in a resin such as an acryl resin, grinding the pitch-embedded resin until the pitch surface appears outside and then measuring the pitch surface reflectivity by an apparatus for measuring reflectivity. In the measurement, the wavelength of monochromatic light used was 547 nm, the inner diameter of visual field for the measurement was 8 micron and the points measured were 30 points optionally selected from the optically isotropic portion of a material to be measured. The arithmetic average of the values obtained by measurement at said 30 points was deemed to be the reflectivity of the optically isotropic portion of the material so measured. Thus, only optically isotropic pitches having a reflectivity of 9.0–11.0% so measured are useful as the starting material for high performance carbon fibers.

Pitches for producing the specific isotropic pitches according to this invention as well as processes for producing the latter are not limited as far as they can produce the specific isotropic pitches having the specific reflectivity according to this invention.

Pitches for producing the specific ones according to this invention include coal tar pitch and petroleum-derived pitches with the latter being particularly preferred.

Starting pitches, including certain heavy fraction oils, suitable for producing the specific pitches include:

(1) a heavy fraction oil boiling at substantially 200°–450° C. obtained as a by-product at the time of steam cracking of petroleum, such as naphtha, kerosene or light oil, at usually 700°–1200° C. to produce olefins such as ethylene and propylene, (2) a heavy fraction oil boiling at substantially 200°–450° C. obtained as a by-product at the time of fluidized catalytic cracking of petroleum such as kerosene, light oil or atmospheric pressure bottom oils at a temperature of 450°–550° C. and a pressure of atmospheric to 20 $Kg/cm^2 \cdot G$ in the presence of natural or synthetic silica·alumina catalyst or zeolite catalyst, (3) a pitch obtained by incorporating 100 parts by volume of said heavy fraction oil (1) with 10–200 parts by volume of aromatic hydrocarbons of 2–3 rings having their nuclei at least partly hydrogenated to form a mixed oil and then heat treating the thus formed mixed oil at a temperature of 380°–480° C. and a pressure of 2–50 $Kg/cm^2 \cdot G$, (4) a pitch obtained by incorporating 100 parts by volume of said heavy fraction oil (2) with 10–200 parts by volume of aromatic hydrocarbons of 2–3 rings having their nuclei at least partly hydrogenated to form a mixture and then heat treating the thus formed mixture at a temperature of 380°–480° C. and a pressure of 2–50 $Kg/cm^2 \cdot G$, (5) a pitch obtained by heat treating said heavy fraction (1) at a temperature of 400°–500° C. under a hydrogen pressure of 20–350 $Kg/cm^2 \cdot G$, (6) a pitch obtained by heat treating said heavy fraction oil (2) at a temperature of 400°–500° C. under a hydrogen pressure of 20–350 $Kg/cm^2 \cdot G$, (7) a pitch obtained by (A) incorporating 100 parts by volume of said heavy fraction oil (1) with 10–200 parts by volume of a hydrogenated oil (2) obtained by contacting with hydrogen in the presence of a hydrogenating catalyst a fraction (i) boiling at 160°–400° C. produced at the time of steam cracking of petroleum and/or a fraction (ii) boiling between 160°–400° C. produced at the time of heat treating at 380°–480° C. a heavy fraction oil boiling at not lower than 200° C. obtained at the time of steam cracking of petroleum, to hydrogenate 10–70% of aromatic nuclei of the aromatic hydrocarbons contained in the fractions (i) and (ii)

thereby to obtain a mixture of the oils (1) and (2) and then (B) heat treating the thus obtained mixture at a temperature of 380°–480° C. under a pressure of 2–50 Kg/cm$^2$·G thereby obtaining the pitch, and (8) a pitch obtained by mixing together the heavy fraction oil (1), heavy fraction oil (2) and hydrogenated oil (3) in such amounts that the ratio by weight of said heavy fraction oil (1) to said heavy fraction oil (2) is 1:0.1–9 and the ratio by weight of the total of said heavy fraction oils (1) and (2) to said hydrogenated oil (7) is 1:0.1–2, to obtain a mixture and then heat treating the thus obtained mixture at a temperature of 380°–480° C. under a pressure of 2–50 Kg/cm$^2$·G thereby obtaining the pitch. Among the abovementioned starting pitches for producing the specific pitch according to this invention, the heavy fraction oil (1) and the pitches (3), (5), (7) and (8) are preferred.

The nucleus-hydrogenated aromatic hydrocarbons of 2–3 rings used in the preparation of the pitches (3) and (4) include naphthalene, indene, biphenyl, acenaphthylene, anthracene, phenanthrene and their $C_{1-3}$ alkyl-substituted compounds, in each of which 10–100%, preferably 10–70% of the aromatic nuclei have been hydrogenated. More specifically, they include decalin, methyldecalin, tetralin, methyltetralin, dimethyltetralin, ethyltetralin, isopropyltetralin, indane, decahydrobiphenyl, acenaphthene, methylacenaphthene, tetrahydroacenaphthene, dihydroanthracene, methylhydroanthracene, dimethylhydroanthracene, ethylhydroanthracene, tetrahydroanthracene, hexahydroanthracene, octahydroanthracene, dodecahydroanthracene, tetradecahydroanthracene, dihydrophenanthrene, methyldihydrophenanthrene, tetrahydrophenanthrene, hexahydrophenanthrene, octahydrophenanthrene, dodecahydrophenanthrene and tetradecahydrophenanthrene. This may be used alone or in combination. Particularly preferred are nucleus-hydrogenated aromatic hydrocarbons obtained from bicyclic or tricyclic condensed aromatic hydrocarbons.

The methods for producing the specific pitches according to this invention are not specifically limited. These specific pitches may be obtained, for example, by a method comprising melting the starting material for the specific pitches to make it liquid in an inert gas atmosphere, forming the melted liquid material into a filmy shape having a thickness of preferably up to 5 mm and then heat treating the thus obtained films at 250°–350° C., preferably 280°–345° C., and a reduced pressure, preferably 0.1–10 mmHg, for 1–30 minutes, preferably 5–20 minutes. Thus, by the use of such a method, the starting material may be converted to a pitch having a reflectivity of 9.0–11.0%. Pitches having a reflectivity of less than 9.0% will not produce high performance carbon fibers therefrom, while those having a reflectivity of more than 11.0% are difficult to spin uniformly.

The specific optically isotropic pitches having the specific reflectivity are melt spun by a usual method to obtain pitch fibers, infusibilized, carbonized or further graphitized to obtain carbon fibers having high tensile modulus and high tensile strength.

The melt spinning may be effected usually by adjusting the melt spinning temperature to a temperature approximately 40°–70° C. higher than the softening point of the specific pitch and extruding the thus melted pitch through nozzles having a diameter of 0.1–0.5 mm so that the resulting carbon filters are taken up at a velocity of 200–2000 m/min. on take-up rolls.

The pitch fibers obtained by melt spinning the starting pitch are then infusibilized in an oxidizing gas atmosphere (20–100% concentration). The oxidizing gases which may usually be used herein, include oxygen, ozone, air, nitrogen oxides, halogen and sulfurous acid gas. These oxidizing gases may be used singly or in combination. The infusibilizing treatment may be effected at such temperature that the pitch fibers obtained by melt spinning are neither softened nor deformed; thus, the infusibilizing temperature may be, for example, 20°–360° C., preferably 20°–300° C. The time for the infusibilization may usually be in the range of 5 minutes to 10 hours.

The pitch fibers so infusibilized are then carbonized or further graphitized to obtain carbon fibers. The carbonization or graphitization is effected by heating the infusibilized pitch fibers at a heat-raising rate of 5°–20° C./min. to 800°–3500° C. and maintaining them at this temperature for one second to one hour.

This invention will be better understood by the following non-limitative Examples and Comparative Examples.

EXAMPLE 1

There was recovered a heavy fraction oil (A) produced as a by-product at the time of steam cracking at 830° C. of naphtha. The characteristics of the heavy fraction oil (A) are as shown in Table 1. The oil (A) was heat treated at 400° C. and 15 Kg/cm$^2$·G for 3 hours to obtain a heat treated oil (B). The thus obtained oil (B) was distilled at 250° C./1.0 mmHg to obtain a fraction (C) boiling at 160°–400° C. The characteristics of the fraction (C) are as shown in Table 2. The fraction (C) was contacted with hydrogen at 330° C., 35 Kg/cm$^2$·G and a LHSV of 1.5 to effect partial nuclear hydrogenation thereby obtaining a hydrogenated oil (D). The degree of nuclear hydrogenation was 31%.

Fifty (50) parts by volume of the heavy fraction oil (A) were mixed with 50 parts by volume of the hydrogenated oil (D) to form a mixture which was heat treated at 430° C. and 20 Kg/cm$^2$·G for 3 hours to obtain a heat treated oil. The thus obtained heat treated oil was distilled at 250° C./1.0 mmHg to distil off the light fraction thereby obtaining a starting pitch (1) having a softening point of 100° C. The thus obtained starting pitch (1) was measured for reflectivity by the use of a reflectivity measuring apparatus produced by Leitz Company (Ernst Leitz G.m.b.H.) and found to have a reflectivity of 8.8%.

TABLE 1

| Distillation Characteristics of Heavy Fraction Oil (A) | | |
|---|---|---|
| Specific gravity (15° C./4° C.) | | 1.039 |
| Distillation characteristics | Initial boiling point | 192 (°C.) |
| | 5 (%) | 200 |
| | 10 | 206 |
| | 20 | 217 |
| | 30 | 227 |
| | 40 | 241 |
| | 50 | 263 |
| | 60 | 290 |
| | 70 | 360 |

TABLE 2

| Distillation Characteristics of Fraction (C) | |
|---|---|
| Specific gravity (15° C./4° C.) | 0.991 |
| Refractive index ($n_D^{25}$) | 1.5965 |
| Molecular weight | 145 |

TABLE 2-continued

| Distillation Characteristics of Fraction (C) | | |
|---|---|---|
| Distillation characteristics | Initial boiling point | 160 (°C.) |
| | 10 (%) | 200 |
| | 30 | 215 |
| | 50 | 230 |
| | 70 | 256 |
| | 90 | 305 |

The starting pitch (1) was treated at a temperature of 345° C. and a reduced pressure of 1 mmHg by the use of a film evaporator to obtain a specific pitch having a reflectivity of 10.3% and optical isotropy.

The thus obtained specific pitch was melt spun at a spinning temperature of 300° C. and a take-up velocity of 800 m/min. by the use of a spinner having 0.3 mm-diameter nozzles and L/D=1 to obtain pitch fibers of 12μ in diameter which were then infusibilized, carbonized and graphitized under the following conditions to obtain carbon fibers.

Infusibilizing conditions: Raised at 1° C./min. to 300° C. and maintained at this temperature for 30 minutes in air.

Carbonizing conditions: Raised at 10° C./min. to 1000° C. and maintained at this temperature for 30 minutes in a nitrogen atmosphere.

Graphitizing conditions: Raised at 50° C./min. to 2000° C. and maintained at this temperature for one minute in an argon stream for heat treatment.

The carbon fibers so obtained had a 10-μ diameter, a tensile strength of 250 Kg/mm$^2$ and a tensile modulus of 25 ton/mm$^2$.

Comparative Example 1

The starting pitch (1) as obtained in Example 1 was melt spun at a spinning temperature of 150° C. and a take-up velocity of 800 m/min. by the use of the spinner as used in Example 1 to obtain pitch fibers of 12μ in diameter which were then infusibilized, carbonized and graphitized under the same conditions as in Example 1 thereby obtaining carbon fibers. The thus obtained carbon fibers had a 10-μ diameter, a tensile strength of 80 Kg/mm$^2$ and a tensile modulus of 8 ton/mm$^2$.

Comparative Example 2

The starting pitch (1) as obtained in Example 1 was treated at a temperature of 400° C. and a reduced pressure of 1 mmHg for 15 minutes by the use of a film evaporator to obtain a pitch having a reflectivity of 11.3%.

The thus obtained pitch was melt spun at a spinning temperature of 320° C. and a take-up velocity of 800 m/min. by the use of the spinner as used in Example 1 with the result that it was impossible to obtain uniform pitch fibers.

EXAMPLE 2

One hundred and fifty (150) ml of the heavy fraction oil (A) as obtained in Example 1 were charged into a 300-ml autoclave provided with an agitator, heated at 3° C./min. to 430° C. under and maintained at this temperature for 3 hours under an initial hydrogen pressure of 100Kg/cm$^2$·G, after which the heating was stopped and the temperature lowered to room temperature to obtain a liquid product. The thus obtained liquid product was distilled at 250° C./1 mmHg to distil off the light fraction thereby to obtain a starting pitch (2) having a softening point of 105° C. and a reflectivity of 8.9%.

The pitch (2) so obtained was treated at 345° C./1 mmHg for 15 minutes by the use of a film evaporator to obtain a specific pitch having a reflectivity of 9.8%.

The specific pitch so obtained was melt spun at a spinning temperature of 305° C. and a take-up velocity of 250 m/min. by the use of a spinner having 0.15 mm-diameter nozzles and L/D=1 to obtain 13μ-diameter pitch fibers which were then infusibilized, carbonized and graphitized under the same conditions as in Example 1 to obtain carbon fibers having a 10-μ diameter, a tensile strength of 240 Kg/mm$^2$ and a tensile modulus of 23 ton/mm$^2$.

Comparative Example 3

The starting pitch (2) as obtained in Example 2 was melt spun at a spinning temperature of 160° C. and a take-up velocity of 780 m/min. by the use of a spinner having 3 mm-diameter nozzles and L/D=2 to obtain pitch fibers of 13μ in diameter which were firstly infusibilized by heating to 70° C. for 3 hours in an ozone atmosphere and further heating at 1° C./min. to 200° C., then at 3° C./min. to 300° C. and maintained at this temperature for 30 minutes in air, secondly carbonized and finally graphitized in the same manner as in Example 1, thereby to obtain carbon fibers. The thus obtained carbon fibers had an 11-μ diameter, a tensile strength of 70 Kg/mm$^2$ and a tensile modulus of 7 ton/mm$^2$.

Comparative Example 4

The starting pitch (2) as obtained in Example 2 was treated at 380° C. and a reduced pressure of 1 mmHg for 20 minutes by the use of a film evaporator to obtain a pitch having a reflectivity of 11.4%.

The thus obtained pitch was melt spun at a spinning temperature of 330° C. and a take-up velocity of 780 m/min. by the use of a spinner having 0.3 mm-diameter nozzles and L/D=2 with the result that uniform pitch fibers could not be obtained.

EXAMPLE 3

There was obtained a heavy fraction oil (E) boiling at not lower than 200° C. produced as a by-product at the time of fluidized catalytic cracking at 500° C. of light oil in the presence of zeolite catalyst. The characteristics of the thus obtained oil (E) are as shown in Table 3.

TABLE 3

| Distillation Characteristics of Heavy Fraction Oil (E) | | |
|---|---|---|
| Specific gravity (15° C./4° C.) | | 0.965 |
| Distillation characteristics | Initial boiling point | 320 (°C.) |
| | 5 (%) | 340 |
| | 10 | 353 |
| | 20 | 370 |
| | 30 | 385 |
| | 40 | 399 |
| | 50 | 415 |
| | 60 | 427 |
| | 70 | 445 |

One hundred and fifty (150) ml of the thus obtained heavy fraction oil (E) were introduced into a 300-ml autoclave provided with an agitator, heated at 3° C./min. to 430° C. and maintained at this temperature for 3 hours under an initial hydrogen pressure of 100 Kg/cm$^2$·G, after which the heating was stopped and the reaction product cooled to room temperature. The resulting liquid product was distilled at 250° C./1 mmHg to distil off the light fraction thereby obtaining a starting pitch (3). The thus obtained starting pitch (3) had a softening point of 110° C. and a reflectivity of 8.8%.

The starting pitch (3) was treated at a temperature of 345° C. and a reduced pressure of 1 mmHg for 15 minutes by the use of a film evaporator to obtain a specific isotropic pitch having a reflectivity of 9.4%.

The specific pitch so obtained was melt spun at a spinning temperature of 295° C. and a take-up velocity of 810 m/min. by the use of the spinner as used in Example 1 to obtain 12μ-diameter pitch fibers which were infusibilized, carbonized and graphitized under the same conditions as used in Example 1 to obtain carbon fibers. The thus obtained carbon fibers had an 11-μ diameter, a tensile strength of 200 $Kg/mm^2$ and a tensile modulus of 20 $ton/mm^2$.

Comparative Example 5

The starting pitch (3) as obtained in Example 3 was melt spun at a spinning temperature of 160° C. and a take-up velocity of 770 m/min. by the use of the spinner as used in Example 1 to obtain 13μ-diameter pitch fibers which were then infusibilized under the same conditions as used in Comparative Example 3, carbonized and graphitized under the same conditions as used in Example 1 to obtain carbon fibers. The thus obtained carbon fibers had an 11-μ diameter, a tensile strength of 100 $Kg/mm^2$ and a tensile modulus of 9 $ton/mm^2$.

Comparative Example 6

The starting pitch (3) as obtained in Example 3 was treated at 400° C. and a reduced pressure of 1 mmHg for 15 minutes by the use of a film evaporator to obtain a pitch having a reflectivity of 12.0%.

The thus obtained pitch was melt spun at a spinning temperature of 335° C. and a take-up velocity of 790 m/min. by the use of the spinner as used in Example 1 with the result that uniform pitch fibers could not be obtained.

Comparative Example 7

A pitch, Ashland 240LS (softening point of 120° C.), which was a commercially available petroleum pitch, was treated at 350° C. and a reduced pressure of 1 mmHg for 15 minutes by the use of a film evaporator to obtain a pitch having a reflectivity of 11.2%.

The thus obtained pitch was melt spun at a spinning temperature of 310° C. and a take-up velocity of 800 m/min. with the result that uniform pitch fibers could not be obtained.

EXAMPLE 4

Sixty (60) parts by weight of the heavy fraction oil (A) as obtained in Example 1, 30 parts by weight of the heavy fraction oil (E) as obtained in Example 3 and 10 parts by weight of the hydrogenated oil (D) as obtained in Example 1, were mixed together to form a mixed oil which was then heat treated at 410° C. and 20 $Kg/cm^2 \cdot G$ for 3 hours to obtain a heat treated oil. The thus obtained heat treated oil was distilled at 250° C./1.0 mmHg to distil off the light fraction thereby obtaining a starting pitch (4) having a reflectivity of 8.8%.

The starting pitch (4) so obtained was treated at 345° C. and a reduced pressure of 1 mmHg for 15 minutes by the use of a film evaporator to obtain a specific isotropic pitch having a reflectivity of 10.1%.

The specific pitch so obtained was melt spun, infusibilized, carbonized and graphitized under the same conditions as used in Example 1 to obtain carbon fibers having a 10-μ diameter, a tensile strength of 255 $Kg/mm^2$ and a tensile modulus of 30 $ton/mm^2$.

What is claimed is:

1. In a process for the production of carbon fibers comprising melt spinning a pitch to obtain pitch fibers, infusibilizing the thus obtained pitch fibers, carbonizing or further graphitizing the thus infusibilized pitch fibers to obtain high performance carbon fibers, the improvement which consists of melting a starting point to obtain a liquid pitch, forming the thus formed liquid pitch to a thin film having a thickness not greater than 5 mm in thickness, treating said film at a temperature of 250°–350° C. under reduced pressure of 0.1–10 mm Hg for 1–30 minutes to obtain a specific optically isotropic pitch having a reflectivity of 9.0–11.0% as measured using monochromatic light having a wavelength of 547 nm, melt spinning said optically isotropic pitch to obtain pitch fibers, infusibilizing the thus obtained pitch fibers and then carbonizing or graphitizing the infusibilized pitch fibers to obtain carbon fibers, wherein the starting pitch is a pitch obtained by incorporating 100 parts by volume of a heavy fraction oil (a) boiling at substantially 200°–450° C. obtained as a by-product at the time of steam cracking at 700°–1200° C. of petroleum comprising at least one member selected from naphtha, kerosene and light oil to produce olefins including ethylene and propylene, with 10–200 parts by volume of aromatic hydrocarbons of 2–3 rings having their nuclei at least partly hydrogenated to form a mixed oil and then heat treating the thus formed mixed oil at a temperature of 380°–480° C. and a pressure of 2–50 $Kg/cm^2 \cdot G$.

2. In a process for the production of carbon fibers comprising melt spinning a pitch to obtain pitch fibers, infusibilizing the thus obtained pitch fibers, carbonizing or further graphitizing the thus infusibilized pitch fibers to obtain high performance carbon fibers, the improvement which consists of melting a starting pitch to obtain a liquid pitch, forming the thus formed liquid pitch to a thin film having a thickness not greater than 5 mm in thickness, treating said film at a temperature of 250°–350° C. under reduced pressure of 0.1–10 mm Hg for 1–30 minutes to obtain a specific optically isotropic pitch having a reflectivity of 9.0–11.0% as measured using monochromatic light having a wavelength of 547 nm, melt spinning said optically isotropic pitch to obtain pitch fibers, infusibilizing the thus obtained pitch fibers and then carbonizing or graphitizing the infusibilized pitch fibers to obtain carbon fibers, wherein the starting pitch is a pitch obtained by incorporating 100 parts by volume of a heavy fraction oil (b) boiling at substantially 200°–450° C. obtained as a by-product at the time of fluidized catalytic cracking of petroleum comprising at least one member selected from kerosene, light oil and atmospheric pressure bottom oils, at a temperature of 450°–550° C. and a pressure of atmospheric to 20 $Kg/cm^2 \cdot G$ in the presence of natural or synthetic silica.alumina catalyst or zeolite catalyst, with 10–200 parts by volume of aromatic hydrocarbons of 2–3 rings having their nuclei at least partly hydrogenated to form a mixture and then heat treating the thus formed mixture at a temperature of 380°–480° C. and a pressure of 2–50 $Kg/cm^2 \cdot G$.

3. In a process for the production of carbon fibers comprising melt spinning a pitch to obtain pitch fibers, infusibilizing the thus obtained pitch fibers, carbonizing or further graphitizing the thus infusibilized pitch fibers to obtain high performance carbon fibers, the improvement which consists of melting a starting pitch to obtain a liquid pitch, forming the thus formed liquid pitch to a thin film having a thickness not greater than 5 mm in thickness, treating said film at a temperature of 250°-350° C. under reduced pressure of 0.1-10 mm Hg for 1-30 minutes to obtain a specific optically isotropic pitch having a reflectivity of 9.0-11.0% as measured using monochromatic light having a wavelength of 547 nm, melt spinning said optically isotropic pitch to obtain pitch fibers, infusibilizing the thus obtained pitch fibers and then carbonizing or graphitizing the infusibilized pitch fibers to obtain carbon fibers, wherein the starting pitch is a pitch obtained by heat treating a heavy fraction oil (a) boiling at substantially 200°-450° C. obtained as a by-product at the time of steam cracking at 700°-1200° C. of petroleum comprising at least one member selected from naphtha, kerosene and light oil to produce olefins including ethylene and propylene at a temperature of 400°-500° C. under a hydrogen pressure of 20-350 Kg/cm$^2$·G.

4. In a process for the production of carbon fibers comprising melt spinning a pitch to obtain pitch fibers, infusibilizing the thus obtained pitch fibers, carbonizing or further graphitizing the thus infusibilized pitch fibers to obtain high performance carbon fibers, the improvement which consists of melting a starting pitch to obtain a liquid pitch, forming the thus formed liquid pitch to a thin film having a thickness not greater than 5 mm in thickness, treating said film at a temperature of 250°-350° C. under reduced pressure of 0.1-10 mm Hg for 1-30 minutes to obtain a specific optically isotropic pitch having a reflectivity of 9.0-11.0% as measured using monochromatic light having a wavelength of 547 nm, melt spinning said optically isotropic pitch to obtain pitch fibers, infusibilizing the thus obtained pitch fibers and then carbonizing or graphitizing the infusibilized pitch fibers to obtain carbon fibers, wherein the starting pitch is a pitch obtained by heat treating at a temperature of 400°-500° C. under a hydrogen pressure of 20-350 Kg/cm$^2$·G, a heavy fraction oil boiling at substantially 200°-450° C. obtained as a by-product at the time of fluidized catalytic cracking of petroleum comprising at least one member selected from kerosene, light oil and atmospheric pressure bottom oils, at a temperature of 450°-550° C. and a pressure of atmospheric to 20 Kg/cm$^2$·G in the presence of natural or synthetic silica.alumina catalyst or zeolite catalyst.

5. In a process for the production of carbon fibers comprising melt spinning a pitch to obtain pitch fibers, infusibilizing the thus obtained pitch fibers, carbonizing or further graphitizing the thus infusibilized pitch fibers to obtain high performance carbon fibers, the improvement which consists of melting a starting pitch to obtain a liquid pitch, forming the thus formed liquid pitch to a thin film having a thickness not greater than 5 mm in thickness, treating said film at a temperature of 250°-350° C. under reduced pressure of 0.1-10 mm Hg for 1-30 minutes to obtain a specific optically isotropic pitch having a reflectivity of 9.0-11.0% as measured using monochromatic light having a wavelength of 547 nm, melt spinning said optically isotropic pitch to obtain pitch fibers, infusibilizing the thus obtained pitch fibers and then carbonizing or graphitizing the infusibilized pitch fibers to obtain carbon fibers, wherein the starting pitch is a pitch obtained by (A) incorporating 100 parts by volume of a heavy fraction oil (a) boiling at substantially 200°-450° C. obtained as a by-product at the time of steam cracking at 700°-1200° C. of petroleum comprising at least one member selected from naphtha, kerosene and light oil to produce olefins including ethylene and propylene, with 10-200 parts by volume of a hydrogenated oil (c) obtained by contacting with hydrogen in the presence of a hydrogenating catalyst a fraction (i) boiling at 160°-400° C. produced at the time of steam cracking of petroleum or a hydrogenated oil obtained by contacting with hydrogen in the presence of a hydrogenated catalyst, a fraction (ii) boiling between 160°-400° C. produced at the time of heat treating at 380°-480° C. a heavy fraction oil boiling at not lower than 200° C. obtained at the time of steam cracking of petroleum or a hydrogenated oil obtained by contacting with hydrogen a mixture of fraction (i) and fraction (ii), to hydrogenate 10-70% of aromatic nuclei of the aromatic hydrocarbons contained in aromatic nuclei of the aromatic hydrocarbons contained in the fractions (i) and (ii) thereby to obtain a mixture of the oils (a) and (c) and then (B) heat treating the thus obtained mixture at a temperature of 380°-480° C. under a pressure of 2-50 Kg/cm$^2$·G thereby obtaining a pitch.

6. In a process for the production of carbon fibers comprising melt spinning a pitch to obtain pitch fibers, infusibilizing the thus obtained pitch fibers, carbonizing or further graphitizing the thus infusibilized pitch fibers to obtain high performance carbon fibers, the improvement which consists of melting a starting pitch to obtain a liquid pitch, forming the thus formed liquid pitch to a thin film having a thickness not greater than 5 mm in thickness, treating said film at a temperature of 250°-350° C. under reduced pressure of 0.1-10 mm Hg for 1-30 minutes to obtain a specific optically isotropic pitch having a reflectivity of 9.0-11.0% as measured using monochromatic light having a wavelength of 547 nm, melt spinning said optically isotropic pitch to obtain pitch fibers, infusibilizing the thus obtained pitch fibers and then carbonizing or graphitizing the infusibilized pitch fibers to obtain carbon fibers, wherein the starting pitch is a pitch obtained by mixing together the heavy fraction oil (a) boiling at substantially 200°-450° C. obtained as a by-product at the time of steam cracking at 700°-1200° C. of petroleum comprising at least one member selected from naphtha, kerosene and light oil to produce olefins including ethylene and propylene, heavy fraction oil (b) boiling at substantially 200°-450° C. obtained as a by-product at the time of fluidized catalytic cracking of petroleum comprising at least one member selected from kerosene, light oil and atmospheric pressure bottom oils, at a temperature of 450°-550° C. and a pressure of atmospheric to 20 Kg/cm$^2$·G in the presence of natural or synthetic silica.alumina catalyst or zeolite catalyst and hydrogenated oil (c) obtained by contacting with hydrogen in the presence of a hydrogenating catalyst a fraction (i) boiling at 160°-400° C. produced at the time of steam cracking of petroleum or a hydrogenated oil obtained by contacting with hydrogen in the presence of a hydrogenation catalyst said fraction (i) together with a fraction (ii) boiling between 160°-400° C. produced at the time of heat treating at 380°-480° C. a heavy fraction oil boiling at not lower than 200° C. obtained at the time of steam cracking of petroleum or a mixture of said fraction (i) and said fraction (ii), to hydrogenate 10-70% of aromatic nuclei of the aromatic hydrocarbons containing in the fractions (i) and (ii), in such amounts that the ratio by weight of said heavy fraction oil (a) to said heavy fraction oil (b) is 1:0.1-9 and the ratio by weight of the total of said heavy fraction oils (a) and (b) to said hydrogenated oil (c) is 1:0.1-2, to obtain a mixture and then heat treating the thus obtained mixture at a temperature of 380°-480° C. under a pressure of 2-50 Kg/cm$^2$·G.

* * * * *